US007694973B1

(12) United States Patent
Hofmeister et al.

(10) Patent No.: US 7,694,973 B1
(45) Date of Patent: Apr. 13, 2010

(54) SYSTEM, APPARATUS, AND METHOD FOR RAPIDLY DISPLACING AN OBJECT

(75) Inventors: Michael K. Hofmeister, Decatur, AL (US); Gregory T. Roden, Hartselle, AL (US); Bryan H. Graves, Somerville, AL (US)

(73) Assignee: Strategic Systems, Inc., Decatur, AL (US)

( * ) Notice: Subject to any disclaimer, the term of this patent is extended or adjusted under 35 U.S.C. 154(b) by 834 days.

(21) Appl. No.: 11/364,923

(22) Filed: Mar. 1, 2006

Related U.S. Application Data

(60) Provisional application No. 60/658,143, filed on Mar. 3, 2005.

(51) Int. Cl.
*F41J 7/00* (2006.01)

(52) U.S. Cl. ..... 273/406; 273/391; 273/392; 273/407

(58) Field of Classification Search ..... 463/51–52, 463/56; 434/16–19; 473/17–19, 57, 73, 473/81–82, 86–87; 273/367, 406, 390, 391, 273/392, 407; 119/839
See application file for complete search history.

(56) References Cited

U.S. PATENT DOCUMENTS

| | | | | | |
|---|---|---|---|---|---|
| 320,924 | A * | 6/1885 | Darby | ..... | 277/513 |
| 3,064,976 | A * | 11/1962 | Kuhn | ..... | 273/369 |
| 3,128,096 | A * | 4/1964 | Hammond et. al. | ..... | 273/367 |
| 3,324,832 | A * | 6/1967 | Mccain | ..... | 119/839 |
| 4,540,182 | A * | 9/1985 | Clement | ..... | 273/392 |
| 4,732,394 | A * | 3/1988 | Stein et al. | ..... | 273/391 |
| 5,403,017 | A * | 4/1995 | Doss et al. | ..... | 273/372 |
| 5,603,505 | A * | 2/1997 | Acock | ..... | 273/391 |
| 5,791,992 | A * | 8/1998 | Crump et al. | ..... | 463/41 |
| 5,967,522 | A * | 10/1999 | Corcoran et al. | ..... | 273/406 |
| 6,027,411 | A * | 2/2000 | Huhne | ..... | 473/73 |
| 6,073,932 | A * | 6/2000 | Elliott | ..... | 273/406 |
| 6,257,584 | B1 * | 7/2001 | Nasuti | ..... | 273/407 |
| 6,358,155 | B1 * | 3/2002 | Huhne | ..... | 473/73 |
| 2003/0171190 | A1 * | 9/2003 | Rice | ..... | 482/57 |

* cited by examiner

*Primary Examiner*—James S McClellan
(74) *Attorney, Agent, or Firm*—George P. Kobler; Lanier Ford Shaver & Payne, P.C.

(57) ABSTRACT

An apparatus for rapidly displacing an object comprises a lever with an object end and a power end. The lever is mounted to a fulcrum between the ends. A driven cam has a trunnion attached proximal to an outer edge thereof, and a tie rod member has an end pivotally attached to the power end of the lever and a second end pivotally attached to the trunnion such that about 180° of rotation of the cam causes about 90° displacement of the power end of said lever. Also, a tension member is coupled to the power end such that restorative force of the tension member contributes to displacement of the power end in one direction. A motor drives rotation of the cam.

12 Claims, 3 Drawing Sheets

SYSTEM, APPARATUS, AND METHOD FOR RAPIDLY DISPLACING AN OBJECT

CROSS-REFERENCE TO RELATED APPLICATIONS

This application claims the benefit of Provisional Application Ser. No. 60/658,143, filed Mar. 3, 2005, and incorporated by reference herein.

GOVERNMENT LICENSE RIGHTS

The U.S. Government has a paid-up license in this invention and the right in limited circumstances to require the patent owner to license others on reasonable terms as provided for by the terms of contract No. FA8650-04-C-1715 awarded by the United States Air Force.

BACKGROUND

Military and law enforcement groups receive substantial benefit from training by simulating missions that require the use of firearms in a staged scenario. The greater the realism of the scenario, the better the experience for the trainees. Such missions often require trainees to achieve the mission objective while working against human adversaries. However, obviously, the use of live weapons is dangerous, and destructive. Such groups often using human adversaries with both trainees and aggressors armed with weapons configured with blank firing apparatus. This training can be expensive to provide. One expensive solution is the use of deployable target mannequins, or silhouettes.

A shortcoming of the current target mannequin systems is that to be rugged enough for continued use, the mannequins are constructed from heavier materials. This means that apparatus used to deploy and re-stow the target mannequins must meet the lifting demand. Conventionally, the result is a bulky, heavy, relatively costly, apparatus for displacing the mannequin.

A low cost, compact apparatus for displacing such mannequins is needed. At the same time such an apparatus may be used to displace any number of other objects using the principals described herein. Further, a system which employs a plurality of such machines is needed.

SUMMARY

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

An apparatus for rapidly displacing an object comprises a lever with an object end and a power end. The lever is mounted to a fulcrum between the ends. A driven cam has a trunnion attached proximal to an outer edge thereof, and a tie rod member has an end pivotally attached to the power end of the lever and a second end pivotally attached to the trunnion such that about 180° of rotation of the cam causes about 90° displacement of the power end of the lever. Also, a tension member is coupled to the power end such that restorative force of the tension member contributes to displacement of the power end in one direction. A motor drives rotation of the cam.

This and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The various embodiments of the present invention and their advantages are best understood by referring to FIGS. 1 through 4 of the drawings. The elements of the drawings are not necessarily to scale, emphasis instead being placed upon clearly illustrating the principles of the invention. Throughout the drawings, like numerals are used for like and corresponding parts of the various drawings.

The drawings represent and illustrate examples of the various embodiments of the invention, and not a limitation thereof. It will be apparent to those skilled in the art that various modifications and variations can be made in the present inventions without departing from the scope and spirit of the invention as described herein. For instance, features illustrated or described as part of one embodiment can be included in another embodiment to yield a still further embodiment. Moreover, variations in selection of materials and/or characteristics may be practiced to satisfy particular desired user criteria. Thus, it is intended that the present invention covers such modifications as come within the scope of the features and their equivalents.

This invention may be provided in other specific forms and embodiments without departing from the essential characteristics as described herein. The embodiments described below are to be considered in all aspects as illustrative only and not restrictive in any manner. The claims appended hereto, rather than the following description, indicate the scope of the invention.

Figure 1A:
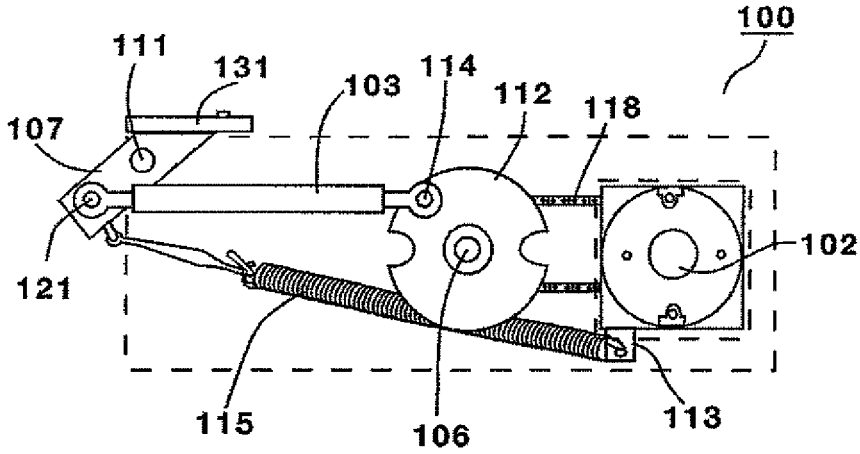
FIG. 1A is an elevational cut-away view of an exemplary displacement apparatus according to an embodiment of the present.
Figure 1B:
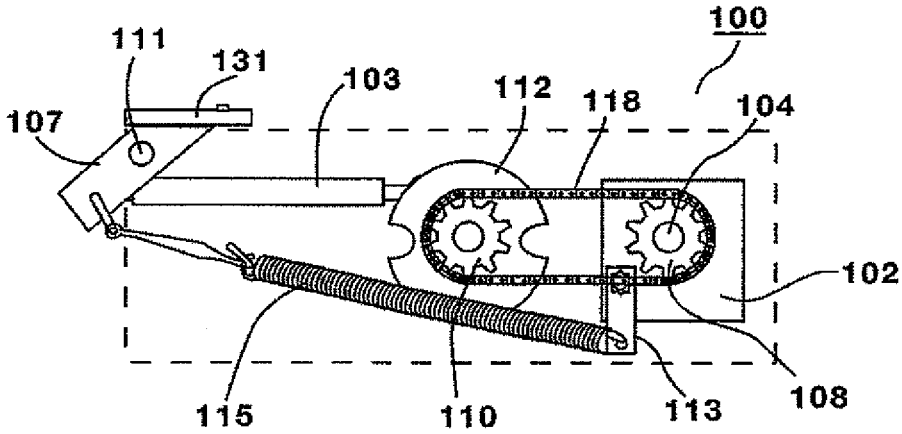
FIG. 1B is an elevational cut-away view from the reverse angle of the exemplary displacement apparatus shown in FIG. 1A.
Figure 1C:
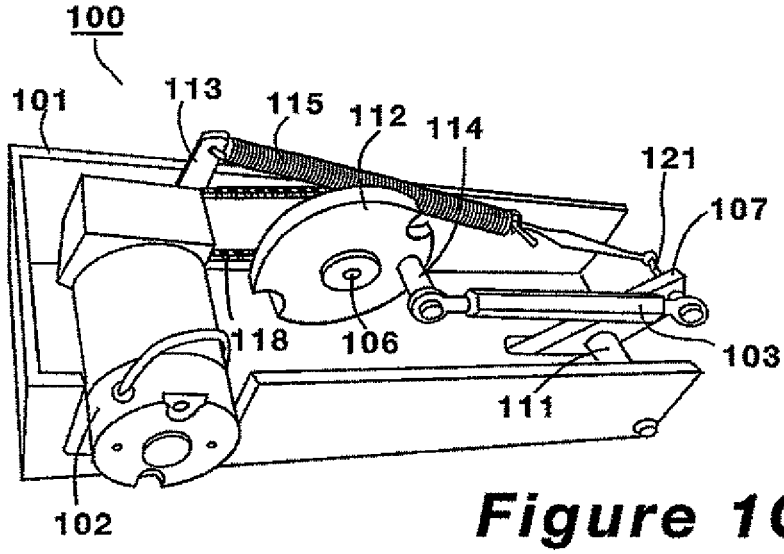
FIG. 1C is a perspective view of the exemplary displacement apparatus according to the embodiment of the present invention as shown in FIGS. 1A, B.
Figure 2:
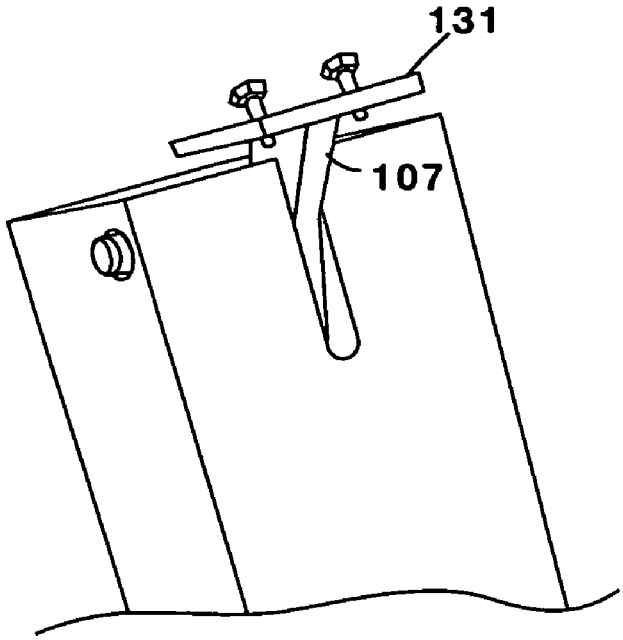
FIG. 2 is a view of one end of the apparatus with object end of lever in a deployed position according to an embodiment of the present invention.
Figure 3:
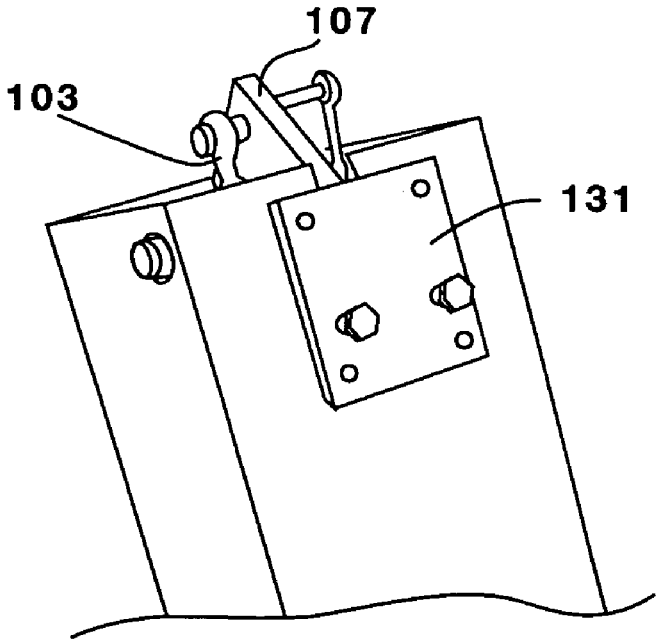
FIG. 3 is another view of the end of the apparatus shown in FIG. 3 with object end of the lever in a stowed position.
Figure 4:
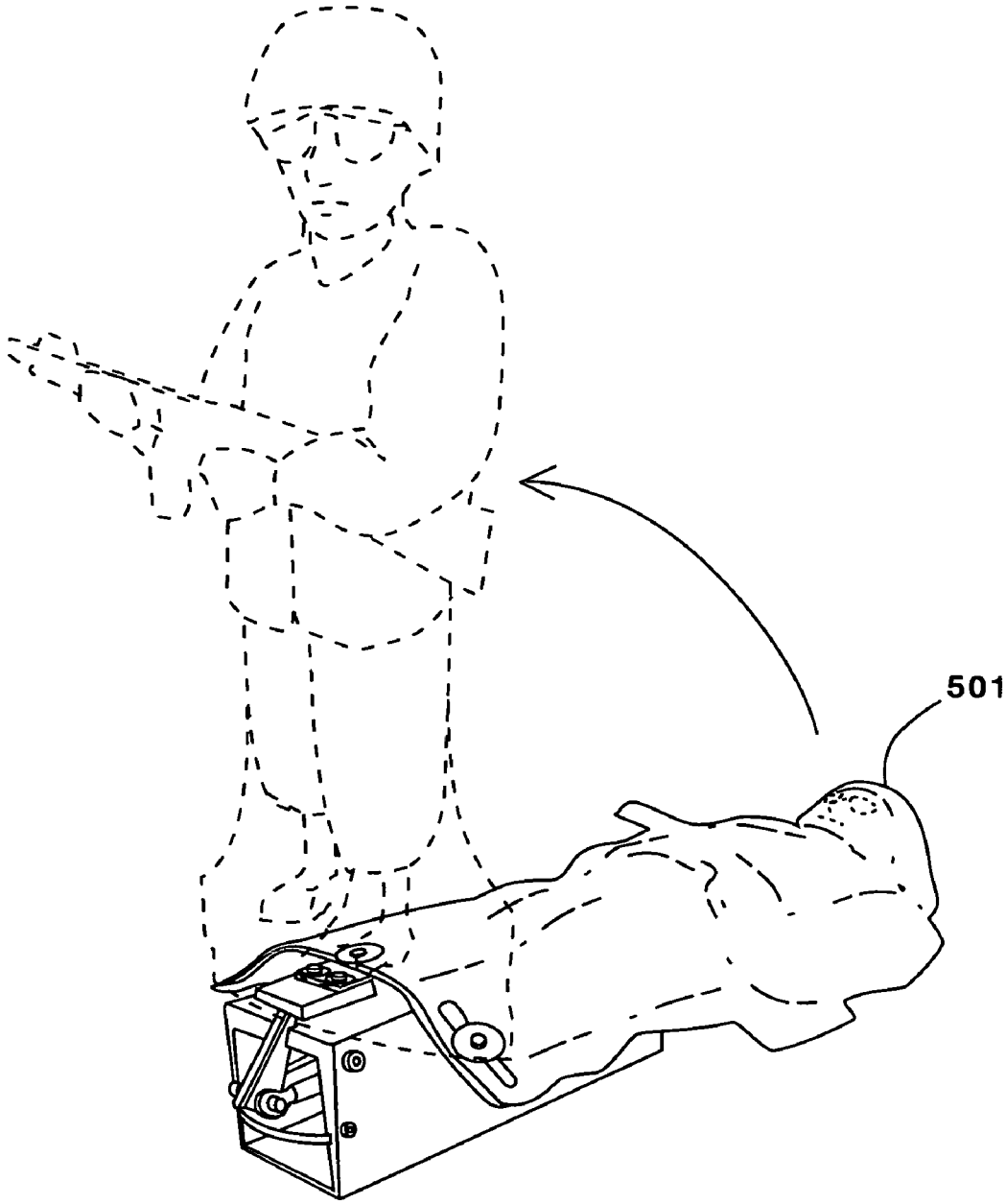
FIG. 4 illustrates one use of the displacement apparatus according to an embodiment of the present invention.

With reference to FIG. 1, an object displacing apparatus 100 according to one embodiment of the present invention comprises a housing 101 within which is mounted a motor 102 coupled to a rotor shaft 104. Affixed to the rotor shaft 104 is a drive gear 108 which is engaged with a drive chain 118. Distally from rotor shaft, drive chain 118 is also engaged with a cam gear 110 mounted upon a cam shaft 106 upon which is also mounted a cam 112. Attached to cam 112 is a cam trunnion 114 to which is pivotally connected tie rod member 103. Cam trunnion 114 is attached near an outer edge of the cam 112. The distal end of tie rod member 103 from cam trunnion 112 is pivotally connected to a power end of a lever member 107. A distal end of lever member 107 is attached to the object desired to be moved, referred to herein as the object end, and may include a suitable object mounting support 131. Lever member 107 is mounted to, and pivotally supported by, an axle 111, that acts as the fulcrum for the lever mechanism.

The embodiment also includes a tension member 115 that is connected at one end to a support stanchion 113 with an opposing end that can be pivotally connected to first end of lever member 107. A second trunnion 121 may be used to provide the pivot point and connection means for both the tie rod member 103 and tension member 115. By way of non-limiting example, second trunnion 121 may be a single, unitary pin affixed to lever member 107 through an aperture in lever member 107. Support stanchion 113 may be mounted to motor casing, or other suitable mounting base, including, without limitation, the housing 101.

As would be appreciated by those skilled in the arts, motor may be any motive apparatus the output of which is torque, preferably an electric motor, a non-limiting example of which is a 12VDC motor. Drive chain, drive gear, and cam gear assembly may also be achieved by a belt engaging both a drive pulley mounted on rotor shaft and a cam pulley mounted upon the cam shaft. Those skilled in the relevant arts will recognize that the pulleys may be substituted for the gears and the belt substituted for the drive chain. Moreover, it will be appreciated that transfer of force from motor to cam may be achieved in any manner now known in the art or hereafter developed. For example, cam may be mounted directly to rotor shaft, eliminating the drive chain and gears. Finally, tension member may be any suitable elastic member, non-limiting examples of which include a spring and an elastic band.

In operation, motor 102 is energized and rotates rotor shaft 104 which in turn rotates drive gear 108. The rotation of drive gear 108 pulls drive chain 118 engaged therewith. Pulling of the drive chain 118, also engaged with cam gear, causes the cam gear to rotate thereby rotating the cam shaft and, therefore, the cam mounted thereto. It should be noted that in the preferred embodiment, motor 102 and, therefore, cam 112, rotate in only one direction. Thus, there is no need for reciprocating motion in the motor, or for added gearing to actuate the cam in a reciprocal manner.

Rotation of the cam 112 causes angular displacement of the cam trunnion 114 which pulls or pushes the tie rod member 103 depending upon the portion of cam rotation through which the trunnion 114 is traveling. For example, for a cam 112 turning in a clockwise direction, trunnion 114 is moved in a clockwise direction as well, pushing rod member 103 by virtue of the pivoting connection with the rod member as trunnion 114 travels through half of the circular travel distance. As the cam 112 is turned again, trunnion 114 is moved through the remaining portion of the circular motion, this time pulling the rod member 103.

Pulling and pushing of the tie rod member actuates lever member whereby the pulling of the tie rod 103 applies force to the power end of lever 107, causing it to pivot around the axle 111. This in turn causes the object end of lever 107 to move. Mounting support 131 can be obliquely angled with respect to lever 107 so that support 131 lies in a parallel position with respect to the longitudinal axis of the apparatus 100 when in a stowed condition and perpendicular to the longitudinal axis when lever 107 is actuated. This means that lever 107 is mounted with respect to the longitudinal axis of the apparatus 100 at a less acute angle, decreasing the size of the apparatus 100.

Rapid actuation of lever 107 is achieved with the force contributed by the restorative tendency of tension member 115. In the stowed condition, lever 107 power end is extended and tension member 115 is also extended. Therefore, restorative force of tension member 115 acts upon lever 107 power end, and when lever 107 power end is pulled, the restorative force of the tension member 115 contributes to pull the lever more rapidly than being pulled using the cam/tie rod actuation alone. It will be appreciated by those skilled in the art that tension member 115 may be selected for the strength of its restorative force, based, in part, upon the weight of the object desired to be displaced.

As mentioned above, the apparatus 100 may be contained in a housing assembly comprised of a cap member (not shown) and a container member 101. Cap member is generally box-shaped having a planar portion and, at most, three walls extended perpendicularly therefrom, creating a first open portion. Likewise container member 101 is generally box-shaped having a planar portion and at least two walls extending perpendicularly therefrom, creating, at least, second open portion. The planar portion of the container member is formed with a slot-shaped recess therein located at the edge of the planar portion where there is no wall.

The housing 101 is assembled with the apparatus mounted within the container member, by mating the walls of the cap member to the walls of the container member such first and second open portions are joined creating a box with an open end. Cap and container members may be hingedly connected to one another. The apparatus is mounted within container member with axle mounted near the open end so that object end of lever member, when pivotally mounted thereon, extends outside the housing through open end. Object end of lever extends through slot-shaped recess, with plate resting upon outer surface of container member planar portion when the apparatus is in the stowed condition.

Housing 101 may be configured to provide a seat for motor as well, preferably at the end opposing the open end. Housing 101 may be formed with mounting surfaces and apertures for mounting of the various components of the apparatus described above, as would be understood by those skilled in the relevant arts. Further, housing assembly may be formed with apertures that act as vias through which power supply and control inputs, feedback signals may be ported. Alternatively, power supply, e.g., a 12V battery, and any control devices, or communication devices may be contained within housing as well.

In one embodiment, motor is energized, perhaps in response to a control signal, only long enough to rotate the cam 180°. This effects a 90° displacement of the object end of the lever, and the reciprocal stowage of the object as well on an on-demand basis. For example, and with reference to FIG. 5 when the apparatus is used to raise a target mannequin 501 for military or law enforcement arms training, a control signal is sent to energize the motor. Motor is energized for the period of time required to raise the target from a horizontal stowed position to a vertical position. When the target mannequin 501 is hit, a sensor or sensors could provide a signal that initiates a command signal to energize the motor again, returning the mannequin to the stowed position.

Motor could be configured to be responsive to a control device or processor adapted for the intake of communication signals, or sensor signals, processing of such signals, and initiation of command signals to the motor. As would be understood in the art, a processor can be implemented by a field programmable gated array (FPGA), a central processing unit (CPU) with a memory or other logic device, a non-limiting example of which is a programmable logic device (PLD).

The processor may in effect comprise a computer system. Such a computer system could include, for example, one or more processors that are connected to a communication bus. The computer system may also include a main memory, preferably a random access memory (RAM), and can also include a secondary memory. The secondary memory can include, for example, a hard disk drive and/or a removable storage drive. The removable storage drive reads from and/or writes to a removable storage unit in a well-known manner. The removable storage unit, represents a floppy disk, magnetic tape, optical disk, and the like, which is read by and written to by the removable storage drive. The removable storage unit includes a computer usable storage medium having stored therein computer software and/or data.

The secondary memory can include other similar means for allowing computer programs or other instructions to be loaded into the computer system. Such means can include, for example, a removable storage unit and an interface. Examples of such can include a program cartridge and cartridge interface (such as that found in video game devices), a removable memory chip (such as an EPROM, or PROM) and associated socket, and other removable storage units and interfaces which allow software and data to be transferred from the removable storage unit to the computer system.

Computer programs (also called computer control logic) are stored in the main memory and/or secondary memory. Computer programs can also be received via the communications interface. Such computer programs, when executed, enable the computer system to perform certain features of the present invention as discussed herein. In particular, the computer programs, when executed, enable a control processor to perform and/or cause the performance of features of the present invention. Accordingly, such computer programs represent controllers of the computer system of a transceiver.

In an embodiment where the invention is implemented using software, the software can be stored in a computer program product and loaded into the computer system using the removable storage drive, the memory chips or the communications interface. The control logic (software), when executed by a control processor, causes the control processor to perform certain functions of the invention as described herein.

In another embodiment, features of the invention are implemented primarily in hardware using, for example, hardware components such as application specific integrated circuits (ASICs) or field-programmable gated arrays (FPGAs). Implementation of the hardware state machine so as to perform the functions described herein will be apparent to persons skilled in the relevant art(s). In yet another embodiment, features of the invention can be implemented using a combination of both hardware and software.

The sensors employed in with the apparatus, may include, for example, pressure sensors, accelerometers, or infrared or other suitable light sensors, sonic or radar devices, including motion detection sensors. A system, for example a target training system, would be configured to provide a signal from such sensors to the processor, where the processor is configured with logic to compare a received sensor signal with a pre-determined threshold, and to determine whether the received signal meets or exceeds the threshold. If so, the processor may then be configured to initiate a command signal to the motor.

Further, in the field of military or law enforcement threat scenario training, the inventive apparatus may be configured in an array of two or more target actuating devices. A plurality of devices may be in communication with one another, either wirelessly or through cable, using any suitable currently known or hereafter developed communications protocol, for example, Ethernet. TCP/IP. The array may be controlled by a centralized computer system in communication with each of the plurality of devices and configured with control logic to command the actuation of one or more devices to exhibit a desired scenario. The computer system may be further configured to trigger deployment of targets based upon various criteria including sensor input, the stowing of another target, or simply time. It will be appreciated by those skilled in the relevant arts that the computer system would include inputs from the various target devices as well as any sensor devices utilized.

For example, a scenario may have trainee(s) travel through a simulated hostile environment, and, upon detecting the presence of the trainee(s) with motion, infra-red, other types of sensors, the computer system could command the deployment of one or more targets. When trainees react to the targets by possibly firing weapons at them, the targets could be deactivated in response to pressure sensors within target body. Then a command signal may be sent to deploy a different set of targets, possibly located at an angle opposite the first set with respect to the trainee(s).

As described above and shown in the accompanying drawings, the present invention comprises a system, apparatus and related method for rapidly displacing an object. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

We claim:

1. An apparatus for rapidly displacing a target object comprising:

a. a lever having a target object end and a power end, said lever mounted to a fulcrum intermediate said ends;

b. a driven cam having one end of a trunnion attached thereto proximal to an outer edge thereof;

c. a tie rod member having a first end pivotally attached to said power end of said lever and a second end pivotally attached to an opposing end of said trunnion such that substantially 180° of rotation of said cam causes substantially 90° displacement of said power end of said lever;

d. a tension member having an end coupled to said power end such that restorative force of said tension member contributes to displacement of said power end in one direction; and e. motor for driving rotation of said cam.

2. The apparatus of claim 1, wherein said target object end further comprises a target mannequin attached thereto.

3. The apparatus of claim 2, wherein said drive means is configured to intermittently rotate said cam substantially 180°.

4. The apparatus of claim 3, wherein said motor is configured to respond to a control signal.

5. The apparatus of claim 4, wherein said control signal is received from a control processor in response to a detection signal from one of a pressure sensor, a light sensor, an accelerometer, an infrared sensor, a sonic sensor and a radar.

6. An apparatus for lifting a target from a horizontal position to a vertical position comprising:

a. a lever having a power end and an object end to which is obliquely attached said target, said lever mounted to a fulcrum intermediate said ends;

b. a cam having a trunnion attached thereto proximal to an outer edge thereof;

c. a tie rod member having a first end pivotally attached to said power end of said lever and a second end pivotally attached to said trunnion such that substantially 180° of rotation of said cam shaft substantially 90° displacement of said power end of said lever;

d. a tension member having an end coupled to said power end such that restorative force of said tension member contributes to displacement of said power end in one direction; and e. intermittent drive means coupled to said cam configured to rotate said cam substantially 180°.

7. The apparatus of claim 6, wherein said object end further comprises a target mannequin attached thereto.

8. The apparatus of claim 7, wherein said drive means is configured to intermittently rotate said cam substantially 180°.

9. The apparatus of claim 8, wherein said drive means is configured to respond to a control signal.

10. The apparatus of claim 9, wherein said control signal is received from a control processor in response to a detection signal from one of a pressure sensor, a light sensor, an accelerometer, an infrared sensor, a sonic sensor and a radar.

11. A system for deploying one or more target objects from generally horizontal to generally vertical comprising:

a. one or more target object deploying devices comprising a lever having a target object end and a power end, said lever mounted to a fulcrum intermediate said ends; a driven cam having a trunnion attached thereto proximal to an outer edge thereof; a tie rod member having a first end pivotally attached to said power end of said lever and a second end pivotally attached to said trunnion such that substantially 180° of rotation of said cam causes substantially 90° displacement of said power end of said lever; a tension member having an end coupled to said power end such that restorative force of said tension member contributes to displacement of said power end in one direction; drive means for driving rotation of said cam; and a target object coupled to said target object end; and a sensor for detecting when said target object is hit, said sensor being one of a pressure sensor, a light sensor, an accelerometer, an infrared sensor, a sonic sensor and a radar;

b. a control processor configured with control logic to issue a control signal for activating said deploying devices and configured with an input for receiving a detection signal from said sensor.

12. A combat training system comprising:

a. one or more target mannequin deploying devices, each of said devices comprising:

i. a reversible motor for imparting rotation;

ii. a cam mounted for rotation in the vertical plane and driven by said motor;

iii. a tie rod member having a first end pivotally attached to an outer portion of said cam, and a second end, said tie rod member having a generally horizontal orientation;

iv. a lever having first and second lever ends and pivotally mounted to a fulcrum intermediate said lever ends and located above said tie rod, said first lever end pivotally connected to said second tie rod end, said second lever end having a mannequin attached thereto, said lever extending above, and oriented at an acute angle with respect to, said tie rod, such that substantially 180° of rotation of said cam displaces said mannequin between a generally vertical and a generally horizontal position; and v. a tension member having an end coupled to said first lever end such that restorative force of said tension member contributes to displacement of said first lever end.

* * * * *